US009732970B2

(12) United States Patent
Trevelyan

(10) Patent No.: US 9,732,970 B2
(45) Date of Patent: Aug. 15, 2017

(54) LOCALISED PERSONAL AIR CONDITIONING

(75) Inventor: James Trevelyan, Dalkeith (AU)

(73) Assignee: CLOSE COMFORT PTY LTD., Dalkeith, Western Australia (AU)

( * ) Notice: Subject to any disclaimer, the term of this patent is extended or adjusted under 35 U.S.C. 154(b) by 394 days.

(21) Appl. No.: 13/700,112

(22) PCT Filed: Aug. 11, 2011

(86) PCT No.: PCT/AU2011/001025
§ 371 (c)(1),
(2), (4) Date: Nov. 26, 2012

(87) PCT Pub. No.: WO2012/019236
PCT Pub. Date: Feb. 16, 2012

(65) Prior Publication Data

US 2013/0143480 A1 Jun. 6, 2013

(30) Foreign Application Priority Data

Aug. 11, 2010 (AU) ..... 2010903591

(51) Int. Cl.
*A47C 21/04* (2006.01)
*F24F 7/00* (2006.01)
(Continued)

(52) U.S. Cl.
CPC ..... *F24F 7/00* (2013.01); *A47C 21/044* (2013.01); *A47C 29/003* (2013.01); *F24F 1/025* (2013.01);
(Continued)

(58) Field of Classification Search
CPC ..... A47C 21/042; A47C 21/044
(Continued)

(56) References Cited

U.S. PATENT DOCUMENTS 2,159,741 A 8/1933 Kettering et al.
2,071,026 A * 2/1937 Crosley, Jr. ..... 62/305
(Continued)

FOREIGN PATENT DOCUMENTS

CN 1061140 5/1992
CN 1061140 A 5/1992
(Continued)

OTHER PUBLICATIONS

International Search Report regarding PCT/AU/2011/001025, mailed Sep. 20, 2011, 5 pages.
(Continued)

*Primary Examiner* — Avinash Savani
*Assistant Examiner* — Vivek Shirsat
(74) *Attorney, Agent, or Firm* — Pillsbury Winthrop Shaw Pittman, LLP

(57) ABSTRACT

A sleeping space air conditioner including a quiet low powered air conditioner 1, a sleeping space into which conditioned air is delivered, the sleeping space including an upper air pervious section 2 and a lower relatively air impervious section 3 surrounding a bed in the sleeping space, the impervious section 3 extending to a height above the sleeping surface of the bed sufficient to contain the conditioned air as it moves towards and returns from the opposite end or side of the sleeping space, the impervious section 3 extending to a sufficiently increased height above the sleeping surface at the opposite end or side to allow the direction of air flow to reverse towards said one end or side without substantial loss of conditioned air through the pervious section 2.

9 Claims, 2 Drawing Sheets

(51) Int. Cl.

| | |
|---|---|
| ***A47C 29/00*** | (2006.01) |
| ***F24F 1/02*** | (2011.01) |
| ***F24F 13/02*** | (2006.01) |
| ***F24F 13/06*** | (2006.01) |

(52) U.S. Cl.
CPC ..... *F24F 13/0218* (2013.01); *F24F 13/0604* (2013.01)

(58) Field of Classification Search
USPC ..... 454/197, 284; 62/261; 5/284, 423, 726
See application file for complete search history.

(56) References Cited

U.S. PATENT DOCUMENTS

| | | | | |
|---|---|---|---|---|
| 2,695,413 | A | 11/1954 | Ter Maat | |
| 3,230,556 | A | 1/1966 | Shippee | |
| 4,006,604 | A | 2/1977 | Seff | |
| 4,872,397 | A | 10/1989 | Demeter et al. | |
| 5,044,364 | A | 9/1991 | Crowther | |
| 5,943,716 | A | 8/1999 | Chu | |
| 6,167,885 | B1 | 1/2001 | Hanssen | |
| 6,425,255 | B1 | 7/2002 | Hoffman | |
| 6,945,064 | B2 | 9/2005 | Jebaraj | |
| 7,971,596 | B2 * | 7/2011 | Morris | A47C 29/003 135/133 |
| 2002/0121101 | A1 * | 9/2002 | Jebaraj | 62/259.1 |
| 2007/0256433 | A1 * | 11/2007 | Bhatti et al. | 62/121 |
| 2009/0276958 | A1 | 11/2009 | Gururaj | |

FOREIGN PATENT DOCUMENTS

| | | | |
|---|---|---|---|
| CN | 2259099 | | 8/1997 |
| CN | 2259099 | Y | 8/1997 |
| CN | 1163735 | | 11/1997 |
| CN | 1163735 | A | 11/1997 |
| CN | 1393664 | | 1/2003 |
| CN | 2555472 | | 6/2003 |
| CN | 1543895 | | 11/2004 |
| CN | 1729892 | | 2/2006 |
| CN | 2803143 | | 8/2006 |
| CN | 2803143 | Y | 8/2006 |
| CN | 2884009 | | 3/2007 |
| CN | 200965305 | | 10/2007 |
| CN | 101074588 | | 11/2007 |
| CN | 101099624 | | 1/2008 |
| CN | 201019340 | | 2/2008 |
| CN | 1014-6016 | | 5/2008 |
| CN | 201069222 | | 6/2008 |
| DE | 4006968 | | 9/1991 |
| DE | 4020427 | | 1/1992 |
| JP | 3267642 | | 11/1991 |
| JP | 4022307 | | 1/1992 |
| JP | 4028953 | | 1/1992 |
| JP | 4106353 | | 4/1992 |
| JP | 4126940 | | 4/1992 |
| JP | 4126941 | | 4/1992 |
| JP | 4165246 | | 6/1992 |
| JP | 4217731 | | 8/1992 |
| JP | 4236051 | | 8/1992 |
| JP | 4240342 | | 8/1992 |
| JP | 4240344 | | 8/1992 |
| JP | 4270843 | | 9/1992 |
| JP | 2004245544 | | 9/2004 |
| JP | 2004340395 | A | 12/2004 |
| JP | 2008073455 | | 4/2008 |

OTHER PUBLICATIONS www.taskair.com.au; Breathing new life into the modern work place; 2013.
www.evening-breeze.com; The smart alternative to ordinary air conditioning; 2012.

* cited by examiner

LOCALISED PERSONAL AIR CONDITIONING

CROSS-REFERENCE TO RELATED APPLICATIONS

This application is a U.S. National Stage application under 35 USC, §371 of PCT/AU2011/001025 filed 11 Aug. 2011, which claims priority under the Paris Convention to Australian Patent Application 2010903591 filed 11 Aug. 2010, the entire contents of the application being incorporated herein by reference.

Conventional air conditioning devices work mostly by injecting cool air into an enclosed space in which cooling is desired. The air is injected in a way that results in mixing of the air in the space to achieve a relatively uniform temperature and perceived comfort level at any location in the enclosed space. Usually the air is injected by a fan in the air conditioner through one or more vents at relatively high velocity to create mixing throughout the enclosed space. In a displacement air conditioning system, the air is injected at the bottom of the space to create a cool air layer only in the lower section of the space occupied by people.

The air conditioner removes heat from the air by passing it through a heat exchanger containing a cool fluid, or a heat exchanger cooled by some other mechanism such as the Peltier (or thermoelectric) effect.

The air inside the cooled space absorbs heat from the walls, floor, people and other objects inside the space being cooled.

Usually, but not always, the air inside the cooled space is recirculated through the air conditioner to reduce the energy required to maintain cooling.

The heat absorbed from the cooled space air (including the latent heat obtained by condensing water vapour to liquid water) at the evaporator reappears at the condenser where it heats the outside air. The energy used to compress the refrigerant gas also appears at the condenser. Therefore the heat transferred to the warm outside air at the condenser is greater than the heat absorbed from the cooled space air at the evaporator by an amount equal to the electrical energy supplied to the compressor and fans (apart from relatively small amounts of heat lost from the system by other means). The coefficient of performance of the air conditioner is the rate at which heat is absorbed from the cooled space (including the latent heat obtained by condensing water vapour to liquid water) divided by the electrical power supplied to the compressor.

In essence the air conditioner operates as a heat pump, removing heat from air inside the cooled space and transferring this heat, along with the energy used to compress the refrigerant gas, to warmer air outside the cooled space. In addition to the power required to run the compressor, a small additional amount of power is needed to run the fans to move the inside and outside air.

A portable air conditioner can be constructed from an air conditioner similar to known domestic air conditioners. The air conditioner is usually placed inside the room to be cooled and, therefore, a relatively large diameter air tube is required to ensure that hot air from the condenser is exhausted through a window. In some cases, a second air tube carries air from the window to the condenser circulation fan to be pumped through the condenser. The cool air mixes with the room air or, in the case of some inventions discussed below, is directed into a localized part of the room.

A substantial part of the energy used in these conventional air conditioning arrangements results only in cooling of the building structure and the objects inside the cooled space, and removal of heat entering through the roof or ceiling, walls, floor and particularly through open or covered apertures such as the windows and doors. This energy requirement can be reduced by providing additional insulation or by shading the roof, walls, windows and doors. However, these measures are not always possible, particularly with older buildings not designed with energy efficiency in mind.

By localizing the effect of an air conditioner to just a small section of the cooled space, typically away from doors, windows and walls, very large energy savings are possible. People often spend long periods of time at a single location within a room (such as sleeping on a bed) and it is only necessary to keep the upper body and face cooled for a person to feel very comfortable.

This principle has been described in U.S. Pat. No. 6,425,255 by Karl Hoffman, Dec. 26, 2000 (issued Jul. 30, 2002). Further refinements are described in US Patent 2002/0121101 by AsirlyaduraiJebaraj, 2 Jan. 2002 (issued 5 Sep. 2002). This patent also refers to China Patents CN2259099 (San Jianhua et al) and CN1163735 (Tan Mingsen et al) that describe air-conditioned mosquito nets in which outside air is conditioned and supplied to the enclosures and all of the air is exhausted outside the enclosure. China patent CN1061140 (He BaoAn et al) describes an insulating mosquito net with a plurality of inflatable air-pocket walls. Chinese developments also include localised air conditioning for seats in an auditorium.

These were preceded by U.S. Pat. No. 2,159,741 by C. F. Kettering et al, 30 Aug. 1933 (issued 23 May 1939) describes a fabric wall structure around the bed and a small air conditioning unit feeding air into the enclosed walled space over the bed. This invention exploited the displacement air conditioning principle in which it is known that cool air is denser than warmer air and thus remains in the walled enclosure over the bed.

Attempting to localize air conditioning by using a mosquito net, even with relatively fine weave, is inefficient. This difficulty was recognized in CN2803143Y in which the interior of the mosquito net is subdivided with an interior curtain such that only the head of the sleeping person is inside the air conditioned section. The slight density difference between cooler air inside the enclosure and the warmer air outside is sufficient to provide a pressure difference that will allow cool air to rapidly disperse through the net into the room. That is why many patents have disclosed impervious barriers to air flow. However, these can be unattractive for people who need to use the enclosure.

It is evident from the above that there is a need for a localised personal air conditioning system in which the conditioned air is used more effectively to cool a person located in a sleeping space.

Uninterruptible power supplies (UPSs) using battery storage have become popular in regions affected by frequent electricity supply interruptions because they are silent and emit no exhaust fumes. A typical UPS can supply power for several hours to operate low power fluorescent lights, communications equipment and a fan. Typical domestic UPS units can supply between 1000 and 2,500 Watts. In many markets, a high power UPS unit costs up to three times the price of the smallest air conditioner and often the batteries need to be replaced every twelve months or so.

An attractive alternative option is to supply power from a photovoltaic solar cell array through an inverter similar to those used for UPS units.

However, a typical UPS inverter cannot easily provide power for air conditioning. The reason is that the electric motor required to run the compressor (as used in a refrigeration air conditioner) draws up to ten times the normal electric supply current for a brief time, typically 50 to 100 milliseconds, when it starts operating from a stationary condition. While UPS units can supply a larger current for a short time without overloading, the power rating of the UPS unit needs to be about three times larger than the electric motor rating in order for the motor to start reliably. Therefore, one would need a UPS unit with a capacity in excess of 2,000 Watts to run even the smallest air conditioners rated at 600 Watts. Here it should be noted that some of the air conditioners said by their manufacturers to run at a relatively low power rating, for instance 450 Watts, actually require up to twice or two and a half times as much power under certain conditions, including when initially starting up. Therefore they typically cannot be run by a UPS system and instead require a generator that can supply the required power.

Many more people would be able to gain comfort and better sleep by using air conditioning if one could reduce the electric power required for the air conditioning compressor. This can be achieved by significantly reducing the cooling capacity required from the air conditioner. One way to do this is to localize the effect of the air conditioner so that only the air around the head and upper body is cooled.

The invention provides a sleeping space air conditioner including a quiet low powered means for generating a conditioned air flow, means defining a sleeping space into which the conditioned air is adapted to be delivered from one end or side of the sleeping space in a manner which maximizes contact between the conditioned air and a person or persons in the sleeping space, the means defining the sleeping space including an upper air pervious section and a lower relatively air impervious section adapted to surround a bed in the sleeping space and configured to minimize passage of the conditioned air from the sleeping space through the pervious section or other leakage paths, the impervious section extending to a height above the sleeping surface of the bed at the end or side of the bed opposed to said one end or side sufficient to contain the conditioned air as it moves towards and returns from the opposite end or side of the sleeping space, the impervious section extending to a sufficiently increased height above the sleeping surface at the opposite end or side to allow the direction of air flow to reverse towards said one end or side without substantial loss of conditioned air through the pervious section.

In other words a small air conditioning unit is provided to cool the air above a bed inside a fabric enclosure designed to efficiently retain cooled air above the bed and provide a comfortable sleeping environment for two people with a cooling power of about 600 Watts, requiring electrical power of about 270 Watts, well within the capacity of a typical 1000 Watt UPS unit. The fabric enclosure retains the cool air over the bed with sufficient cool air depth to enable efficient circulation and also prevents insects from reaching the sleeping people.

Preferably, the conditioned air flow generating means includes a nozzle having an air flow straightener which maintains an airflow velocity of at least 0.4 m per second over the exposed skin of person(s) in the sleeping space, thereby reducing the tendency of the air flow coming from the nozzle to mix with surrounding air such that higher airflow velocity is maintained at a greater distance from the nozzle.

Preferably, the conditioned airflow generating means includes a return air intake having a sufficient area of pervious material serving as an air filter which maintains an air intake velocity sufficiently low to inhibit warm air above the conditioned air entering the air intake.

In a preferred embodiment the conditioner has an evaporator which is used as an airflow straightener with an air projector nozzle.

In a preferred embodiment the air conditioner defining the sleeping space comprises a fabric enclosure including said impervious and pervious sections.

An embodiment of the invention will now be described with reference to the accompanying drawings which:

Figure 1:
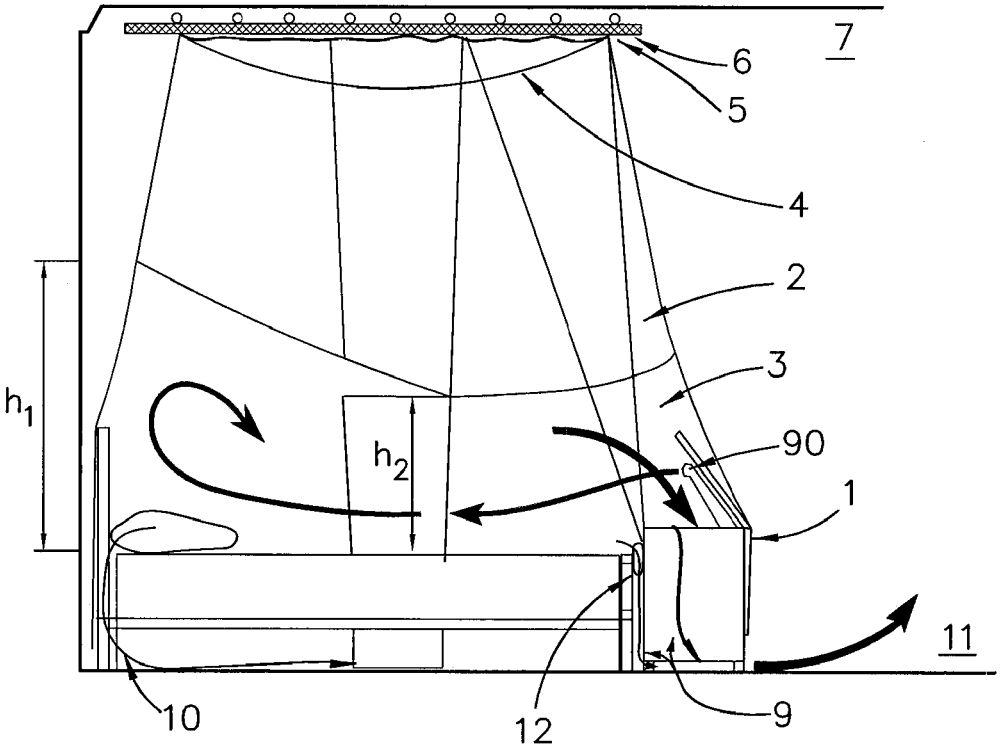
FIG. 1 is a schematic side elevation of a system embodying the invention.

The outlet of the air conditioner (1) in the embodiment described directs a stream of cool air over the bed as shown in FIG. 1. Air returns to the cooler from the enclosed space and enters by an air intake in the top of the unit. Air to cool the condenser is taken from the room air outside the enclosure at floor level and ejected at the back of the unit, also near floor level (11). The room windows should normally be left open allowing warm air from the air cooler to escape.

This overcomes a significant disadvantage of normal room air conditioners. When a room air conditioner is used, the windows must be closed. Many people dislike this and would prefer fresh air from the outside. This invention allows for the room windows to be left open. Even if they are closed, there is minimal warming of the room caused by the relatively small amount of heat released from the air conditioning unit: the net heat released to the room is only the electrical power consumption of the compressor and fans.

The means of localizing the air conditioning effectively permits this embodiment to be used outside in the open air, unlike a normal air conditioner.

When the hinged lid at the top of the unit is lowered, all air inlets and outlets are invisible and protected from dust accumulation. The air conditioning unit, therefore, resembles a normal piece of bedroom furniture when it is not in use.

Referring to FIG. 1, the fabric enclosure consists of two sections. The upper section (2) is made from a fabric suitable as an insect screen and air can pass through this fabric very easily. The lower section (3) is made from a relatively impervious fabric that also has a greater weight per unit area. The lower section of fabric retains the cool air over the bed.

In the arrangement shown in FIG. 1, the air cooler unit (1) is located at the foot end of the bed to keep the source of noise as far from the ears of the sleeping person as possible. The height $h_1$ of the impervious fabric above the mattress at the head end of the bed needs to be at least about 1000 mm. At the foot end of the bed the height $h_2$ needs to be at least about 600 mm. The additional height at the head end is required because the air stream coming from the cooler unit slows down, increasing the static pressure of cool air as predicted by Bernoulli's law. Without this additional height, the cool air would overflow the wall of impervious fabric resulting in unwanted loss to the warmer room air outside. The bottom of the impervious fabric hangs just above the floor level.

Figure 2:
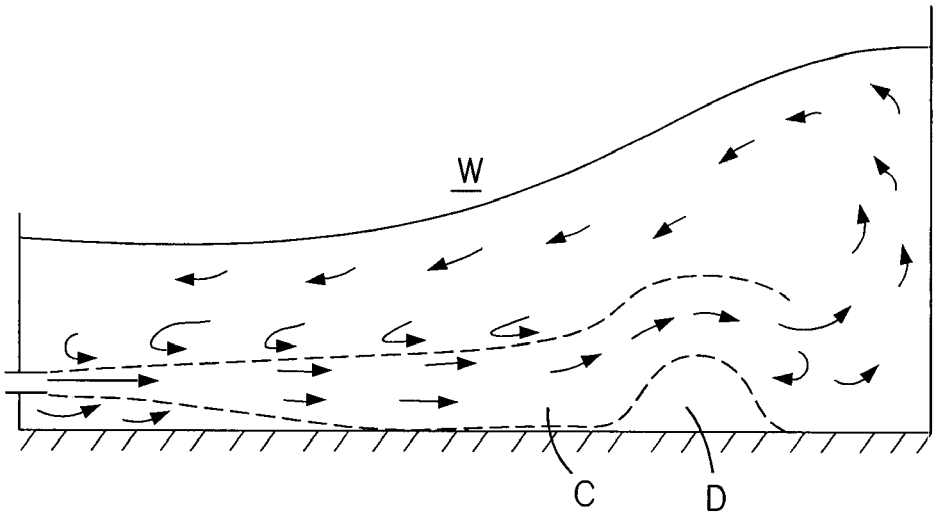
FIGS. 2 and 3 are a simplified representation of air flow where the air enters the left end.

A jet of cool air emerges from the air cooler outlet 90 at about 2.4 meters per second (m/sec). The outlet flow rate is typically about 30-40 liters per second (1/sec), and the temperature is between about 12° and 18°. By using Bernoulli's famous equations that describe incompressible fluid flow, one can show that the static pressure of the cool air jet is lower than the surrounding air. As a result, shown in FIG. 2, surrounding warmer air W tends to mix with the faster moving cool air C. Momentum must be conserved during this mixing process so, while the average velocity decreases with distance from the outlet 90 because of mixing, the total mass of air in the moving jet increases, being the combination of the cool air from the jet and a portion of the surrounding air that has mixed with the cool air and by now is moving with the cooler air. We can estimate the air flow at this location by observing that the velocity is now around 0.4 m/sec. The total air flow (cool air plus warmer air that has mixed with it) is now around 180-200 l/sec. Measurements show that this air mixture is typically between 5° and 7° cooler than ambient air in the room. As this air is denser than the ambient room air, it displaces the warmer cooler air upwards, as shown in FIG. 2.

kinetic energy of this small volume of air is therefore $0.5\rho_i$ dv $u^2$ where u is the velocity, mostly in the horizontal direction. The potential energy represented by the increased depth of cool air at the head end is also easily calculated. For our small volume at rest, near the head end, the potential energy is $(\rho_i-\rho_a)$ dv g $(h_1-h_2)$. Here we use the density difference between the cool air $(\rho_i)$ and the ambient air $(\rho_a)$ because it is this difference that creates the small pressure difference that affects the air velocity. We can equate these two:

$$0.5\rho_i dv u^2=(\rho_i-\rho_a)dv g(h_1-h_2) \quad \text{(Equation 1)}$$

Noting that dv appears on both sides of the equation, we can eliminate it. Thus we can re-arrange the equation and calculate u from:

$$u=(2(\rho_i-\rho_a)g(h_1-h_2)/\rho_i)^{0.5} \quad \text{(Equation 2)}$$

Substituting the values described above, we obtain the following calculated results:

| | | | | |
|---|---|---|---|---|
| Gravitation acceleration | g | 9.81 | m/sec^2 | |
| Level of cool air above head end | head_level | 0.9 | m | |
| Level of cool air above mid point | mid_level | 0.4 | m | |
| Air density @ 20 degrees | Rref | 1.293 | kg/m^3 | |
| Ambient temperature | Ta | 35 | degrees C. | |
| Enclosure air temperature | Ti | 30 | degrees C. | |
| Air density of enclosure air | Ri | 1.25 | kg/m^3 | Rref*293/(Ti + 273) |
| Air density of ambient air | Ra | 1.23 | kg/m^3 | Rref*293/(Ta + 273) |
| Density difference | delta_R | 0.02 | kg/m^3 | Ri − Ra |
| Estimated velocity u2 | u_mid | 0.40 | m/sec | (2*delta_R/Ri*g*(head_level − mid_level))^0.5 |

The cool air reaches the end of the enclosure and has to stop moving horizontally. The depth of cool denser air is greater here.

The depth difference can be calculated from fundamental principles: the same principles that Bernoulli used for his famous equations that describe incompressible fluid flow. The reason for working from fundamental principles is that conventional fluid mechanics texts provide equations that describe the flow of water (or similar fluids) in channels, neglecting the density of the air above. This is reasonable because the air is usually around 800 times less dense than water.

However, in the case of the cool air within the enclosure, the warm air above is only slightly less dense than the cooler air at the bottom. Measurements show, in addition, that there is no clear boundary between the cool air and the warmer air. Instead there is a gradual transition from warmer air to cooler air over a distance of about 0.2-0.4 m. However, we can simplify the calculations by assuming that there is a distinct measurable boundary and still obtain results with sufficient accuracy.

Figure 3:
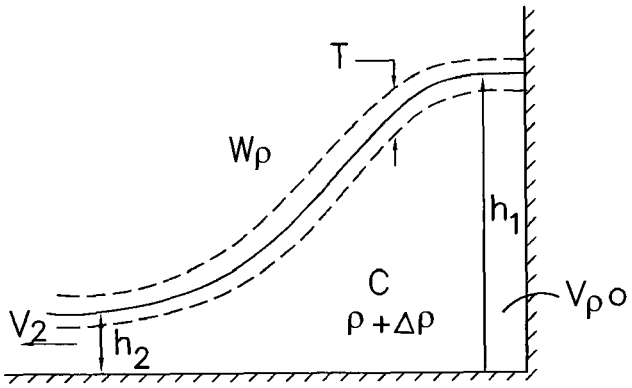

A small elemental volume of air close to the head end has potential energy represented by the greater depth of cool air (with higher density). Away from the head end, the depth of cool air is less and this difference causes two effects. First, the air at the head end needs to recirculate back to the foot end of the bed. Second, the cool air flowing over the head and shoulders of the occupant slows down and starts moving up instead. We treat this phenomenon by equating the kinetic energy of the air in motion to the potential energy difference represented by the different depth of cool air, illustrated in FIG. 3.

A small volume of moving air, dv, has mass $\rho_i$ dv where $\rho_i$ is the density of the cool air inside the enclosure. The What this demonstrates is that if the difference in depth of cool air is 0.5 m, then the expected flow velocity associated with that depth difference is 0.4 m/sec that is what we observe in tests.

The cool air needs to recirculate within the enclosure, partly to provide enough air velocity to create an additional perception of comfort, and partly because the air will be entrained in the jet of conditioned air entering the bed enclosure from the cool air outlet. We can calculate how much space is required for this circulation.

The total flow of mixed cool air over the head and shoulders of the occupant O is about 180 l/sec. At a velocity of 0.4 meters/sec this requires a flow area of 0.46 $m^2$. In fact, the velocity cannot be uniform, so a larger area will be needed, typically around 50% more. Using the measurements obtained to estimate the depth of cool air flowing over the head and shoulders of the occupant; this depth is about 0.3 m. The width of the bed is about 1.8 m, and we need almost this full width to accommodate this flow. Therefore we can conclude that the return air flows over the top of this cooler air layer back to the foot end of the bed. The combined thickness of these two layers needs to be, therefore, about 0.6 m. This corresponds to the observations from experiments. The typical depth of cool air at the head end is around 0.9-1.0 m and at the mid section about 0.4-0.5 m. When we allow for the transition layer between cool and warm air above, we need to allow more depth, and the minimum required will be about 0.1 m greater than these values.

It should be noted that a typical width across the shoulders of a person is 0.45 m. With an occupant sleeping on their side, the shoulder height is greater than the thickness of the cool air layer flowing towards the head end of the bed. However, just as running water flows up and over submerged rocks in a stream, the cool air will flow over the shoulders of the occupant. This will cause some friction flow losses however, but these do not significantly affect the levels of cool air within the enclosure.

An alternative arrangement would be to admit cool air at one end of the bed, say the head end, and extract air from the foot end of the bed to be cooled and recirculated. However, first one has to allow 0.2-0.4 meters transition layer between warm air above and cool air below. Then one has to allow sufficient depth for the air flow to rise over the shoulders of an occupant sleeping on their side, 0.45 m high. This means that the minimum depth of cool air in the enclosure has to be around 0.5 m (0.6 m after allowing for the transition layer). If the impervious part of the fabric curtain containing the cool air is lower than 0.6 m, cool air will overflow the sides of the curtain, significantly reducing the efficiency of the air cooling. In addition significant ducting will be needed to transport the air from one end of the bed to the other end. This ducting is a further source of heat gain due to conduction, reducing the efficiency. Since it is desirable to admit cool air at the head end in this arrangement, there is a further problem that the occupant's ears are closer to the air cooler sound sources, making noise more apparent.

The fabric enclosure may be made in severalsections sewn permanently together. One section 4 made of insect screen material forms the top of the enclosure. Four overlapping hanging sections made from insect screen material at the top (2) and impervious fabric at the bottom part (3) are sewn to the top section in such a way that they overlap horizontally by at least 1000 mm at the top, preferably more. Each piece forms part of the end of the enclosure (either the foot end or the head end) and part of the sides, thereby providing access openings in the ends and the sides. Additional material may need to be gathered at the corners and particularly at the foot end of the bed to allow enough fabric to enclose the air conditioner unit.

Fabric hangs over the sides and ends of the bed to form a continuous air and insect barrier, yet still providing convenient side openings for people to enter or leave the enclosed space.

The overlapping fabric at the openings improves thermal insulation between the enclosure and the outside room air.

Fabric ties sewn to the seam joining the top piece and side pieces enables the fabric enclosure to be attached (5) to supporting light weight rods (6) made from metal, wood or bamboo, for example. The rods are suspended from the ceiling (7) such that they are small distance inwards from a position directly above the edges of the bed. By this means the fabric hangs against the sides and ends of the bed forming an effective barrier to prevent air from cascading over the sides and ends of the bed.

A long tube of lightly stuffed fabric about 100 mm in diameter forms a sealing piece between the air conditioner unit and the bed (12). This also helps to anchor the enclosure fabric in place around the sides of the air conditioner unit to prevent leakage (9, 10) of the air between the enclosure and the warmer room air outside.

During the day, the four hanging sections of the enclosure can be drawn apart and tied to allow convenient access to change or air the sheets and make the bed. The air conditioning unit, being mounted on castors, can be moved near to a work desk where the user can be cooled during the day time.

Since the power consumed by the air conditioner is very low, it is suitable to be powered by solar cells of modest size and cost, particularly if coupled to battery storage for night time operation.

Measurements have revealed that a small air conditioner running with an input power of 270 Watts and cooling the enclosure described provides a temperature reduction of about 5° when the room temperature is 35° and humidity is about 50%. The effect of air movement in the enclosure adds an apparent temperature reduction of 2° enabling the unit to meet the comfort requirements established by research. This is achieved by using a cool outlet air vent that supplies cool air to the enclosed space through an air straightener, reducing turbulence in the outlet air stream. This enables the air conditioner to maintain an air flow velocity across the bed that is around 2 meters per second near the outlet air vent, and about 0.4 meters per second at the head end of the bed, sufficient to achieve the apparent 2° cooling.

Figure 4:
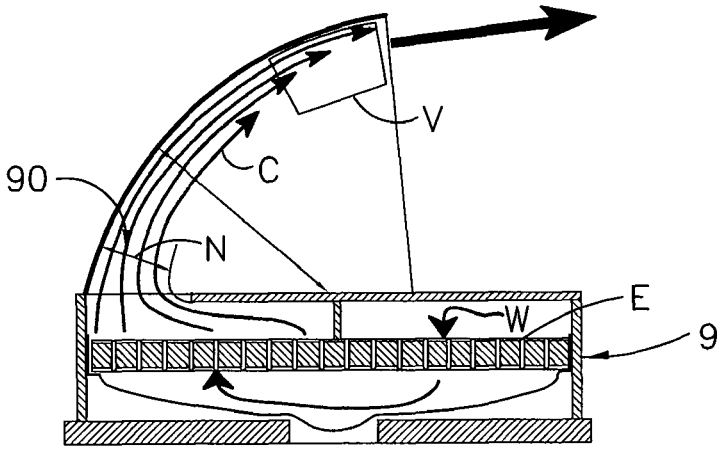
FIG. 4 is a schematic sectional elevation of a suitable projector nozzle.

In an alternative arrangement illustrated in FIG. 4, the evaporator E itself can be used as the flow straightener as it has a multiplicity of closely spaced fins. By arranging for the air flowing from the evaporator to be redirected by the inside of a curved outlet nozzle with a radius of curvature of about 25 cm, the outlet air stream can be directed at a person up to 2 meters from the outlet with minimal turbulence.

Remotely controlled vanes V provide a means of adjusting the direction of the cool air jet.

The arrangement of the return air intake to the air cooler needs careful consideration. The cross section area of the intake and the air flow rate together determine the average velocity of air entering the intake. The maximum entry velocity near the middle of the intake will be slightly higher because the air velocity at the edges will be lower than the average velocity.

The depth of cool air with higher density in the enclosure provides a relative pressure difference to accelerate the air to the intake velocity, by Bernoulli's principle. If the intake air velocity is too high, this pressure will be insufficient. When this happens, warm air above the cool air layer will be sucked into the intake along with a proportion of cool air, in the same way that air can be entrained with the water stream draining from a bath when it is not quite empty. This increases the average temperature of the intake air, reducing the cooling efficiency of the air cooler.

Figure 5:
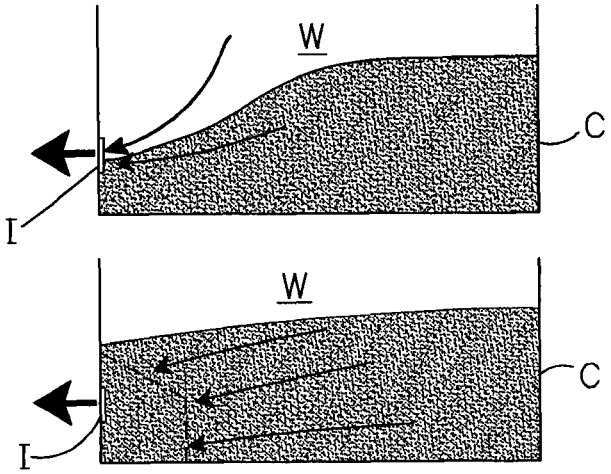
FIG. 5 schematically illustrates the effect of air intake arrangement simple air inlet, a fabric air filter and inlet diffuser.

FIG. 5 illustrates this and shows cool air C trapped inside an enclosure, such as the fabric enclosure that is the subject of this embodiment. In the upper arrangement, a small air intake I removes cool air from the inside of the enclosure. A high exit velocity is required due to the small area of the air intake. The pressure of cool air is insufficient and warm air W enters the air intake as a direct result. The lower arrangement of FIG. 5 shows a pervious fabric diffuser intake with a much greater surface area, shown with a dotted line, also serving as an air filter. Because the entry velocity to the fabric diffuser is much lower, the pressure required to accelerate the air through the intake is much less. Sufficient pressure for this is available from the depth of cool air inside the enclosure. Therefore, no warmer air enters the air intake and the operating efficiency of the air conditioner is improved.

The fabric area must be large enough to keep the inflow velocity to about 0.1 m/sec (approximately 0.4 square meters for a flow of 40 liters per second). This is essential to prevent the warm air layer above the cool air from being drawn into the air intake, as explained above.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A sleeping space air conditioner, comprising:

(a) a quiet, low powered conditioned air flow generating means configured to provide a conditioned air flow; and (b) means defining a sleeping space into which the conditioned air provided by the conditioned air flow generating means is adapted to be delivered from a foot end of the sleeping space in a manner which maximizes contact between the conditioned air and a person or persons in the sleeping space, the means defining the sleeping space including:

(i) an upper air pervious section and (ii) a lower air impervious section configured to retain conditioned air over the sleeping space, the lower air impervious section having a greater weight per unit area than the upper air pervious section, the means defining the sleeping space being adapted to surround a bed in the sleeping space and configured to minimize passage of the conditioned air from the sleeping space through the upper air pervious section or other leakage paths, the lower air impervious section extending to a height above a sleeping surface of the bed at a head end of the bed opposed to said foot end sufficient to contain the conditioned air as it moves towards and returns from the head end of the sleeping space, and the lower air impervious section extending to a sufficiently increased height above the sleeping surface at the head end to allow the direction of air flow to reverse towards said foot end without substantial loss of conditioned air through the upper air pervious section, wherein the conditioned air flow generating means includes:

(i) a cool outlet air vent that supplies conditioned air to the sleeping space through an air flow straightener so as to reduce turbulence in an outlet stream; and (ii) a curved nozzle for redirecting air flowing from the straightener over said person or persons in the sleeping space, wherein airflow velocity of conditioned air from the nozzle is sufficient to reduce the tendency of the air flow to mix with surrounding air such that higher airflow velocity is maintained at a greater distance from the nozzle; and wherein horizontal movement of conditioned air from the nozzle is stopped by the head end of the lower air impervious section of the sleeping space and upwardly displaces warmer, less dense, air so as to gain additional perceived comfort, wherein the conditioned air flow generating means includes a return air intake having a sufficient area of pervious material serving as an air filter, the pervious material being configured and arranged to maintain an air intake velocity sufficiently low to inhibit warm air above the conditioned air to enter the air intake.

2. The air conditioner of claim 1, wherein the conditioner has an evaporator heat exchanger which is used as an airflow straightener with an air projector nozzle.

3. The air conditioner of claim 1, wherein the means defining the sleeping space comprises, at least in part, a fabric enclosure including said lower air impervious and upper air pervious sections.

4. The air conditioner of claim 3, wherein the fabric enclosure is arranged to hang at an angle to the vertical such that the fabric hangs against the sides and ends of the bed such that cool air leakage from the enclosure between the fabric and the edge of the mattress is minimized.

5. The air conditioner of claim 3, wherein conditioned air leakage between the fabric and the edge of the mattress is reduced by the use of magnetic material incorporated into the fabric or some other means by which to the fabric is temporarily secured to the sides of the mattress or bed.

6. The air conditioner of claim 1, wherein the means for generating a conditioned air flow is of sufficiently low electrical power and start up surge current such that it can be operated using a battery back-up power supply, a solar photo voltaic panel, wind powered generator or like power sources.

7. The air conditioner of claim 1, wherein the airflow velocity of conditioned air from the nozzle is approximately 2.4 meters per second.

8. The air conditioner of claim 7, wherein the airflow temperature is between 12 and 18 degrees Celsius.

9. The air conditioner of claim 7, wherein the airflow velocity at a head end of the sleeping space is approximately 0.4 meters per second.

* * * * *